United States Patent [19]

Olofsson

[11] 4,089,177

[45] May 16, 1978

[54] HEAT ENGINE FOR TRANSFORMING HEAT ENERGY TO WORK INCLUDING EJECTOR HEAT PUMP

[76] Inventor: Gosta Olofsson, Sannagatan 15, 68100 Kristinehamn, Sweden

[21] Appl. No.: 721,501

[22] Filed: Sep. 8, 1976

[30] Foreign Application Priority Data

Dec. 22, 1975 Sweden ..... 7500615

[51] Int. Cl.[2] ..... F01K 21/00

[52] U.S. Cl. ..... 60/688; 60/670; 60/685; 60/689

[58] Field of Search ..... 60/643, 645, 651, 670, 60/671, 685, 688, 689

[56] References Cited

U.S. PATENT DOCUMENTS

| | | | |
|---|---|---|---|
| 3,788,064 | 1/1974 | Hawkins | 60/685 |
| 3,861,151 | 1/1975 | Hosokawa | 60/649 |

*Primary Examiner*—Allen M. Ostrager
*Attorney, Agent, or Firm*—Watson, Cole, Grindle & Watson

[57] ABSTRACT

In conjunction with a heat engine such as a turbine in which the medium expands and is cooled while giving up energy, which uses a closed system in which the medium is cooled so that the vaporized medium condenses to fluid, a heat pump is used in which the medium is transported by a compressor utilizing an ejector, particularly an ejector having at least two nozzles for injection of liquid working medium, with the temperature of the working medium fed to the two nozzles being different from each other.

4 Claims, 5 Drawing Figures

HEAT ENGINE FOR TRANSFORMING HEAT ENERGY TO WORK INCLUDING EJECTOR HEAT PUMP

BACKGROUND OF THE INVENTION

Field of the Invention

The invention relates to a turbine or like machine in which a vaporized fluid expands and is cooled, while giving up mechanical energy. More particularly, the invention relates to such a system utilizing a heat pump which includes an ejector.

A heat engine for converting heat energy into mechanical energy always used a medium which is heated up to high temperature at a high pressure. Then the medium may expand in a turbine or any other machine operating by expansion, while both the pressure and the temperature decrease to low levels, while at the same time mechanical energy is delivered to the turbine. Usually the medium is in the state of steam both before the expansion and after. Much heat energy has to be taken off from the medium after the expansion. In open systems this is done by taking the medium out of the system, to be replaced by new medium at the high temperature level. In closed systems it is done by cooling the medium so that the steam condenses to fluid. After that it is pumped up to high pressure and heated up again to convert it to steam and fed into the turbine.

SUMMARY OF THE INVENTION

The invention deals with the method of cooling the medium after the expansion in a heat engine with a closed system. A compressor is used with which the medium is raised from the very low temperature level after the expansion in the turbine (or other type of expansion machine) to a higher temperature level, at which it may be cooled. By using such a compressor, it is possible to work with a very small difference between the two temperatures for heating up the medium and for cooling it, while the temperature drop in the turbine still is large, which is necessary for good efficiency. It is however of no use to have a normal heat pump with a compressor because then the mechanical work from the turbine will be less than the work necessary to drive the compressor. By using ejectors in the compressor, it is possible to increase the efficiency, and still better results are reached when the ejector is constituted as a double ejector, that is, an ejector with two or more nozzles (de Laval type) for injection of liquid of the working medium, when the temperature of the liquid through at least one of the nozzles is higher than the temperature of the liquid through the other nozzles. The invention therefore can be expressed as incorporating a heat pump in a steam engine. Preferably the compressor is constructed with a double ejector.

DESCRIPTION OF THE PREFERRED EMBODIMENTS

In all figures, the element where the working medium expands by delivering mechanical work, a turbine or a machine with cylinders and pistons or any other type of machine for the same purpose, is indicated at 1. It will be exemplified by a turbine in this description. The element where heat energy is taken off from the medium is indicated at 2, and is the cooler. The element where the medium is heated up is indicated at 3 and is the heater. The elements 4 and 19 are pumps, which give the medium (as fluid) a high pressure.

Figure 1:
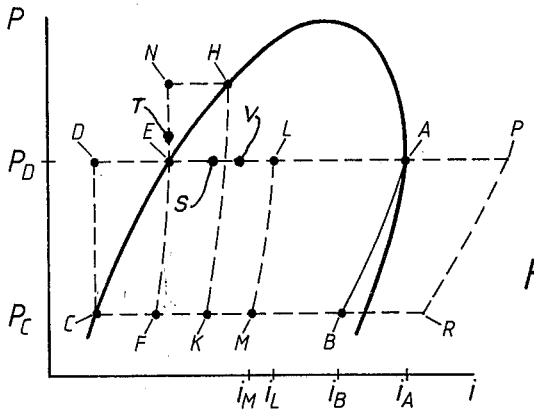
FIG. 1 shows a diagram explanatory of the invention.

In FIG. 1, the points C, D, A, and B give the state of the medium in the conduits 10, 11, 12 and 9 (FIG. 2) respectively. In the heater 3, every kg of the medium receives an amount of energy equal to the difference between the entropies at the points A and D ($i_A - i_D$). The mechanical work in the turbine 1 will be ($i_A - i_B$), and in the cooler 2 the energy $i_B - i_C$ must be taken off from the medium. The energy $i_D - i_C$ will be very small and equal to the amount of energy per kg given to the medium by the pump 4. If the engine works without losses, the greates thermodynamic efficiency will be $$\eta = (i_A + i_C - i_B - i_D)/i_A - i_D$$

It is not necessary that the expansion in the turbine go from point A to B in FIG. 1. It may as well go from P to R or between any other points to the right of A and B, in which cases one works with superheated steam. It may also go between any points to the left of A and B, in which cases one works with a mixture of steam and liquid of the medium, or between the points E and F, in which case the expansion starts with liquid at the boiling point at the pressure $p_E$. The expansion in the turbine is in all these cases thought to be isentropic. It is known that the efficiency will be better the greater the difference is between the temperatures at the points A and B, $t_A - t_B$.

Figure 2:
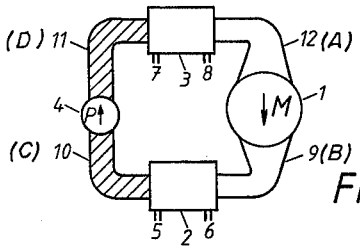
FIG. 2 shows a basic heat engine with a closed circuit for the medium.

Referring to FIG. 2, the elements 9, 10, 11 and 12 are conduits which connect the elements 1, 2, 3 and 4 to form a closed system.

5 and 6 are connections for feeding cooling medium to and withdrawing it from the cooler 2, while 7 and 8 are connections for supplying heating medium to and removing it from the heater 3.

Figure 3:
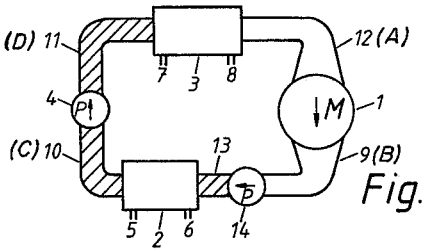
FIG. 3 shows the same circuit combined with a heat pump.

FIG. 3 shows the same circuit as FIG. 2, in which a compressor 14 has also been supplied connected to conduit 9 and connected by conduit 13 to the cooler 2.

Figure 4:
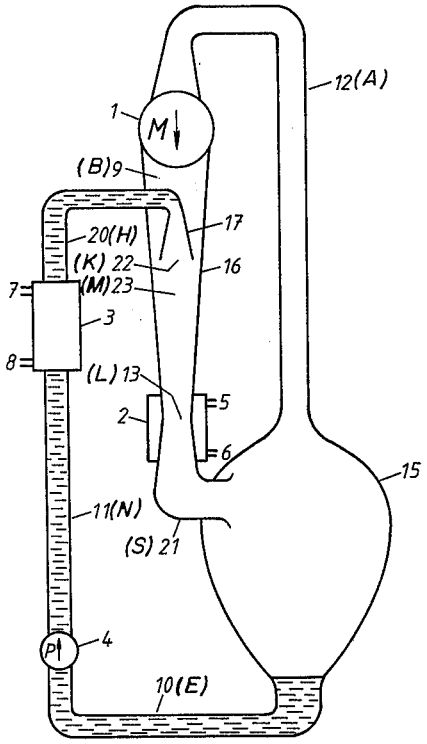
FIG. 4 shows a system embodying a heat pump.

Referring to FIG. 4, there is shown a compressor constituted by an ejector having an envelope 16 and a centrally placed de Laval nozzle 17. 15 is a cyclone or other arrangement for separating steam from liquid, and is designated as a separator.

In equipment according to FIG. 4, the medium circulates in two circuits. One of these is for steam and one for liquid. They are united in the ejector and separated in the separator 15. The steam-circuit will in a simple way be constituted by the conduits 12, 9, 13 and 21. In FIG. 1, the respective state-points are A, B, M and L. The other circuit (for liquid) will in the same way be constituted by the conduits 10, 11, 20, 22, 23, 13 and 21. The respective state-points in FIG. 1 will be E, N, H, K, M, L and S, where S is a point on the line between L and E where the steam-part in the mixture (steam-liquid) is exactly the same as the amount of steam that has come from conduit 9 (and the turbine). Point 22 in the ejector is just at the end of the nozzle 17 and point 23 is just outside this end where the medium from point 22 (nozzle 17) has just been mixed with that coming from conduit 9 but before the pressure has begun to increase (and the velocity to decrease). The temperature at the points B, K and M is very low. The temperature at the points A, E and L is much higher and equal to the temperature at which heat energy is taken off from the medium in the cooler 2, so that some of the steam will be condensed to liquid. The temperature at the points H is still higher. It is to this temperature the medium will be heated up in the heater 3.

The medium-flow through the liquid circuit should be greater than that in the steam circuit. The ratio between these two flows has a great influence on the ratio between the temperature differences $t_E - t_B$ and $t_H - t_E$. It is therefore possible to construct a heat engine according to FIG. 4 that works with a very small difference between the temperatures for heating and cooling, while the temperature drop in the turbine is much larger and therefore the efficiency is acceptable. It will be quite possible to make use of the difference between the temperatures at ground level and in deep water in the sea and in big lakes. It may also be possible to make use of waste heat from industries.

Thus, if in a heat engine according to FIG. 4 the above-mentioned ratio between the flows is 19:1, the highest temperature $t_H$ is $+60°$ C, the working medium is Freon 11 (R11), the result will be as follows, where measurements have been made per kg in the steam-circuit (= 19 kg in the liquid-circuit). $t_E = t_A = 44°$ C, $t_B = -30°$ C, the technical work $W_t = 50$ kJ, the pump-work $W_p = 4,5$ kJ, the heat energy supplied to the medium in the heater $W_v = 299$ kJ. The highest efficiency will be 45.5 : 299 = 15%.

The method of using an ejector in a compressor (separately) is known from the German Pat. No. 1,426,976. The calculations in this example are founded on the same efficiency in the ejector as in that patent.

Figure 5:
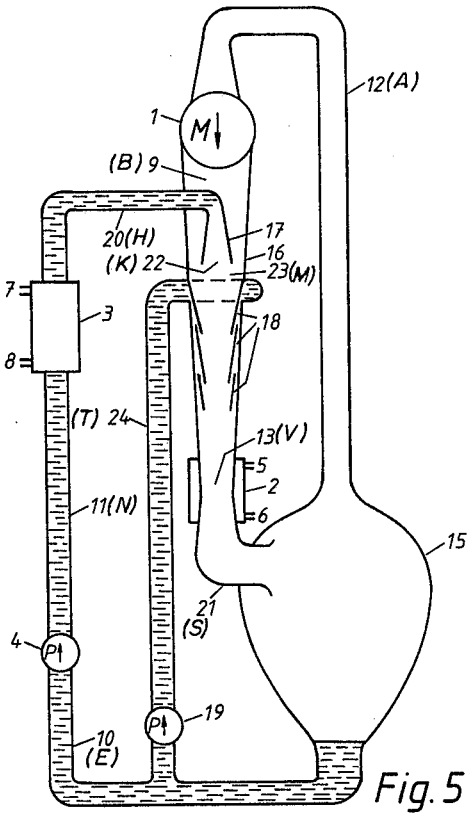
FIG. 5 shows a system embodying a compressor with a double ejector.

The arrangement of FIG. 5 differs from FIG. 4 in that, in addition to the nozzle 17, there are a number of secondary nozzles 18. Nozzle 17 is provided with fluid from a pump 4 which passes it through the heater 3, while nozzles 18 are supplied with liquid by a pump 19. Thus the liquid supplied to the nozzles 18 is at a lower temperature than that supplied to nozzle 17.

The equipment according to FIG. 5 differs from that in FIG. 4 in the construction of the ejector, which is more complicated. It has two or more nozzles, 17 and 18. Liquid medium with the temperature $t_H$ will be forced through the nozzle 17 and liquid with the temperature $t_E$ will be forced through the nozzle 18 (which may be divided into several nozzles). It is not necessary to use the same high pressure to both the nozzles, but it may be desirable to use two pumps, 4 and 19. With this ejector, constituting a double-ejector, it is a great advantage that cool out is ejected in the mixture during the compression. The principle is easy to understand when starting from the description above of the single ejector. It is only to add a second fluid-circuit, conduit 24 and the nozzle 18. The rest of the circuit is common with the other fluid-circuit. When fluid in conduit 24 is forced through the nozzle 18, it will be mixed into the mixture from point 23. The state of the medium at point 23 is the point M in FIG. 1. The state of the medium in conduit 24 is point E in FIG. 1 (or another point with the same entropy but with higher pressure). In the ejector the pressure will increase on the way from 23 to 13 (and the velocity will decrease). During this procedure (compression) the medium from nozzle 18 will be mixed into the mixture. It is desirable to have his happen as continuously as possible in that part of the system. Since the entropy of the fluid from nozzle 18 is much less than the entropy of the mixture at point 23 (M-L in FIG. 1), the result will be that the entropy decreases continuously during the compression. In other words, the increase of the temperature during the compression will be reduced and the compression facilitated.

This method of using a double-ejector can of course be followed in all compressors for only one medium, which have such a characteristic that it can exist as both liquid and steam within the actual temperature-limits. The most common equipment of this type is cooling- and freezing-equipment.

An example of a heat engine according to FIG. 5 has been calculated. The double-ejector has for this purpose been looked upon as two cascade-coupled ejectors which is inferior but easier to calculate. The working medium is Freon 11 (R11) and the proportions such that for 1 kg through the turbine 1, 2 kg will pass the conduit 20 and the nozzle 17 and seventeen kg through the conduits 24 and nozzle 18. The calculators are made per kg through the turbine 1. $t_H = 130°$ C, $t_E - 50°$ C, $T_B = -33°$ C, the pump-work $W_p = 10.4$ kJ, the technical work $W_t = 54$ kJ and heat energy given to the medium in the heater 3 $W_v = 220$ kJ. The efficiency will be 20%.

The result will be better, when consideration is taken of the cooling during the compression (the double-ejector effect).

Another advantage with the double-ejector is that it is easier to adapt the equipment to actual temperatures for heating and cooling.

In all engines according to FIG. 4 or FIG. 5, it is of course possible to use all sorts of regulation that is known from existing engines.

I claim:

1. A heat engine for transforming heat energy into mechanical work by circulating a working medium within a closed system, said heat engine comprising a means for transforming heat energy in a working medium into mechanical work, said means including a working medium inlet and a working medium outlet, the working medium undergoing an expansion and a temperature decrease while passing through said transforming means;

a compressor means connected to the working medium outlet of said transforming means, said compressor capable of increasing the pressure of said work medium passing therethrough;

a cooler means connected to said compressor means, said cooler means capable of cooling a portion of said working medium passing therethrough into liquid form;

a separator means connected to said cooler means capable of separating the liquified working medium from the non-liquified working medium delivered from said cooler means;

means for delivering the non-liquified working medium from said separator means to said working medium inlet of said transforming means;

means for delivering the liquified working medium from said separator means to said compressor means;

means in said means for delivering the liquified working medium from said separator means to said compressor means for increasing the temperature and pressure of said liquified working medium; and said compressor means comprising an ejector including an envelope and a discharge nozzle within said envelope, said means for delivering the liquid working medium from said separator means to said compressor means being connected to said nozzle.

2. A heat engine as claimed in claim 1 wherein said transforming means comprises a turbine.

3. A heat engine as claimed in claim 1 wherein at least one additional discharge nozzle is placed within said envelope of said ejector, and wherein at least one additional means are provided for delivering liquified working medium from said separator means to said compressor means, each additional delivery means being connected to a separate discharge nozzle, the working medium being supplied to the various nozzles being at different temperatures.

4. A heat engine according to claim 3 wherein at least one of said additional discharge nozzles comprises a plurality of discharge outlets spaced in a downstream path relative to the direction of flow of working medium through said ejector.

* * * * *